United States Patent [19]

Kumita et al.

[11] 4,362,913

[45] Dec. 7, 1982

[54] COLLISION DETECTING DEVICE

[75] Inventors: Norio Kumita, Kariya; Takaaki Ori, Nagoya; Seiichi Narita, Chiryu, all of Japan

[73] Assignee: Nippondenso Co., Ltd., Kariya, Japan

[21] Appl. No.: 269,254

[22] Filed: Jun. 1, 1981

[30] Foreign Application Priority Data

Jun. 5, 1980 [JP] Japan ..... 55-78249[U]

[51] Int. Cl.[3] ..... H01H 35/10

[52] U.S. Cl. ..... 200/61.45 R; 200/61.48

[58] Field of Search ..... 200/61.45 R, 61.46, 200/61.48

[56] References Cited

U.S. PATENT DOCUMENTS 4,188,517 2/1980 Narita et al. ..... 200/61.45 R

*Primary Examiner*—J. R. Scott

*Attorney, Agent, or Firm*—Cushman, Darby & Cushman

[57] ABSTRACT

A collision detecting device for automobiles or the like and adapted to produce, upon detection of a collision, an electric signal for actuating a safety device such as an air-bag. The collision detecting device comprises a housing closed at its one end, an end plate closing the end of the housing and provided with a terminal, a wheel having a lapping portion and a mechanism for bringing electrical contacts into and out of contact with each other, a block supporting one end of the shaft of the wheel and fixing the contacts, electrical contacts normally kept away from the contact portion of the terminal but are moved into contact with the latter in the event of a collision, a spring adapted to normally bias the wheel into contact with the projection of the block, a lid provided with a notch for fitting a cylindrical tab of the block and adapted to cover the wheel and the spring, a spring disposed between the lid and the closed end of the housing and adapted to press the lid, and the collision detecting device of the invention can easily be assembled by automatic assembling machines.

4 Claims, 4 Drawing Figures

COLLISION DETECTING DEVICE

BACKGROUND OF THE INVENTION

1. Field of the Invention

The present invention relates to a collision detecting device mounted on automobiles or the like and adapted to actuate a safety device such as an air bag upon detection of a collision of the automobile or the like.

2. Description of the Prior Art

One of the known collision detecting devices is shown in the specification of U.S. Pat. No. 4,188,517. This known collision detecting device incorporates a rotary member having an eccentric centroid, two cams adapted to rotate in synchronism with the rotary member and an electric contact mechanism associated with the cams and adapted to being actuated by the rotation of the cams to generate a signal.

This known device is electrically connected between a seat occupant protecting device mounted on the automobile and an electric power supply. In the event of a collision, the collision detecting device produces a signal to supply the protecting device with an electric current thereby actuating the latter. In this known collision detecting device, the collision is detected through the detection of mechanical displacement of a weight (rotary member) caused by an impact as a result of the collision. More specifically, a cylindrical housing is accommodated by a case which is closed at its one end by an end plate, and the aforementioned rotary member which rotates in response to the collision impact is housed by this housing. The end openings of the housing are closed by a lid and a base, respectively, and an elastic member is disposed between the case and the lid.

This collision detecting device, however, is too complicated in construction and requires an impractically large number of steps for assembling, although it can generate the collision signal without fail.

SUMMARY OF THE INVENTION

Under these circumstances, the present invention aims at providing an improved collision detecting device in which the above-mentioned problems of the prior art, i.e. too complicated construction and difficulty in assembling, are advantageously eliminated.

Namely, it is a major object of the present invention to provide a collision detecting device having a reduced number of parts thereby being easy to automatically assemble by a machine, and capable of opening and closing an electric contact to generate an electric collision signal without fail in the event of a collision.

To this end, according to the invention, there is provided a collision detecting device comprising: a housing which is open at its one end; an end plate closing the open end of the housing and provided with a terminal; a wheel rotatably mounted in the housing and having a mechanism for opening and closing an electric contact and an overlapping portion; a block supporting one end of the wheel and adapted to fix the contact; an electric contact which is normally spaced away from a contact portion on said terminal but is brought into an electric contact with the contact portion in the event of a collision; a spring which generates a force to normally press the wheel against a projection of the block; a lid having a notch for fitting a cylindrical tab of the block; and a spring disposed between the lid and the closed one end of the housing to press the lid; whereby the wheel is stopped by the spring against rotation in the normal state but the spring force is overcome by the force produced by the mass of the wheel to permit the wheel to rotate thereby to make the electric contact produce an electric signal in the event of a collision.

The above and other objects, as well as advantageous features of the invention will become clear from the following description of the preferred embodiment taken in conjunction with the accompanying drawings.

DESCRIPTION OF THE PREFERRED EMBODIMENT

Figure 2:
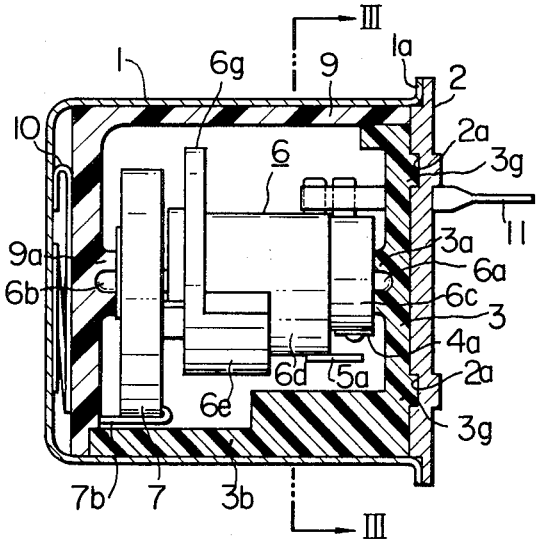
FIG. 2 is a partly-sectioned assembling drawing of the collision detecting device as shown in FIG. 2.

Referring to the drawings showing a preferred embodiment of the invention, a substantially cylindrical iron case 1 is provided at its open end with a flange 1*a* and is plated at its surface with Nickel. An end plate 2, adapted to be fitted in the flange 1*a*, has an outside diameter substantially equal to that of the latter. The flange 1*a* and the end plate 2 are connected to each other by ring projection welding after assembly is completed, so as to form a housing in cooperation with each other. The space inside the case 1 and the end plate 2 are completely sealed from the outside. A block 3 made of a plastic is fixed in the housing. The block 3 is provided with a projection 3*g* (see FIG. 2) adapted to fit in a recess 2*a* formed in the inner surface of the end plate 2. Electrical contacts 4, 5 made of a highly conductive material are provided with portions constituting leaf springs 4*a*, 5*a*. The block 3 is provided with fixture portions 3*c* and 3*d* to which the contacts 5 and 4 are fixed, respectively, by heat caulking or like fixing measures.

A wheel 6 as a rotaty member is made of a plastic and has a central shaft which is supported at its one end 6*a* by a bearing portion of the block 3 and at its other end 6*b* by a bearing portion 9*a* of a lid 9 which will be explained later. The wheel 6 is provided with a disc 6*g* and a weight portion 6*e* which are disposed at the inside of a cylindrical tab 3*f* of the block 3. The wheel 6 is further provided with a cylindrical projection 6*d* which is also placed at the inside of the cylindrical tab 3*f* of the block 3. The leaf spring 4*a* of the contact 4 and the leaf spring 5*a* of the contact 5 make contact with a cam portion 6*c* of the wheel 6 and the peripheral surface of the cylindrical portion 6*d*, respectively. Alternatively, it is possible to arrange wheel 6 such that the cylindrical portion 6*d* has a form of a cam, while the cam portion 6*c* has a cylindrical form.

According to the arrangement stated above, the wheel 6 is rotatable around the axis of the shaft 6*a*, 6*b*. The rotation angle of the wheel 6, however, is limited by the end surface of the internal projection 3*f* of the block 3 which abuts the end surface of the weight 6*e* of the wheel 6.

A spiral spring 7 has a constant width with its inner end 7*a* inserted into a slit 8*a* formed in the cap 8, while the outer end 7*b* of the spiral spring 7 is fixed by means of a notched portion 3*e* provided at the end of the cylindrical tab 3*b* of the block 3.

Normally, the wheel 6 is urged by the force of the spiral spring 7 to keep the end of the overlap 6*e* of the wheel in contact with the end surface of the internal projection 3*f* of the block 3.

Figure 4:
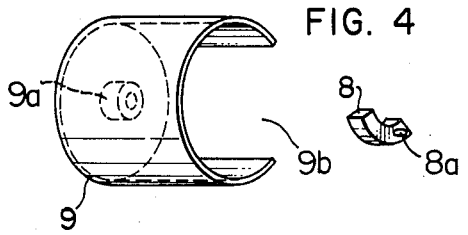
FIG. 4 is a detailed perspective view of the lid.

As shown in FIG. 4, lid 9 has a cylindrical form with one closed end, and is provided with a notched portion 9*b* adapted to fit the cylindrical tab 3*b* of the block 3. The lid 9 is further provided at the inner surface of one end thereof with the bearing 9*a* for supporting the shaft of the wheel 6. Alternatively, it is possible to open the end of the lid 9 and to provide the bearing on the inner surface of the end wall of the case 1.

After fitting flange 1*a* of the case 1 to the end plate 2, the lid 9 is pressed against the end plate 2. In this state, two terminals 11 fixed to the end plate 2 are adapted to make electrical contact with the contacts 4 and 5 to permit conduction of the electric signal to the outside.

Figure 3:
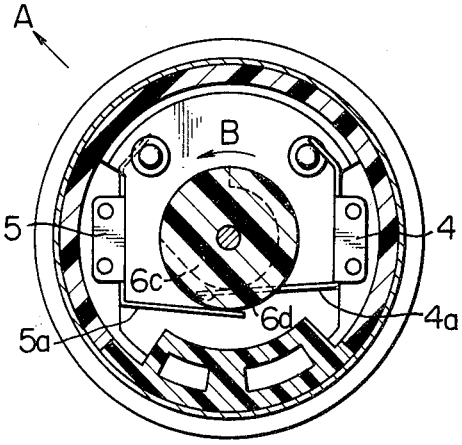
FIG. 3 is a sectional view taken along the arrow lines III—III of FIG. 2.

The collision detecting device of the invention having the described construction operates in a manner explained hereinunder. When the collision impact is applied in the direction of arrow A in FIG. 3, the wheel 6 is rotated in the direction of arrow B as the level of the impacting force acting on the weight 6*e* of the wheel 6 comes to exceed the set load of the spiral spring 7, so that the cams 6*c* and 6*d* are rotated to urge the leaf spring portion 4*a* of the contact 4 and the leaf spring portion 5*a* of the contact 5 downwardly and upwardly, respectively. As a consequence, as the wheel 6 rotates beyond a predetermined angle of rotation, the leaf spring portions 4*a* and 5*a* are brought into contact with each other to complete the electric circuit so that the signal is obtained as an electric current.

However, when the deceleration is below a predetermined value as in the case of the car travelling on a rough road or during abrupt braking, the impacting force is not large enough to overcome the force of the spiral spring 7 so that the wheel 6 cannot rotate beyond the above-described predetermined angle of rotation. Thus, no collision signal is produced.

Figure 1:
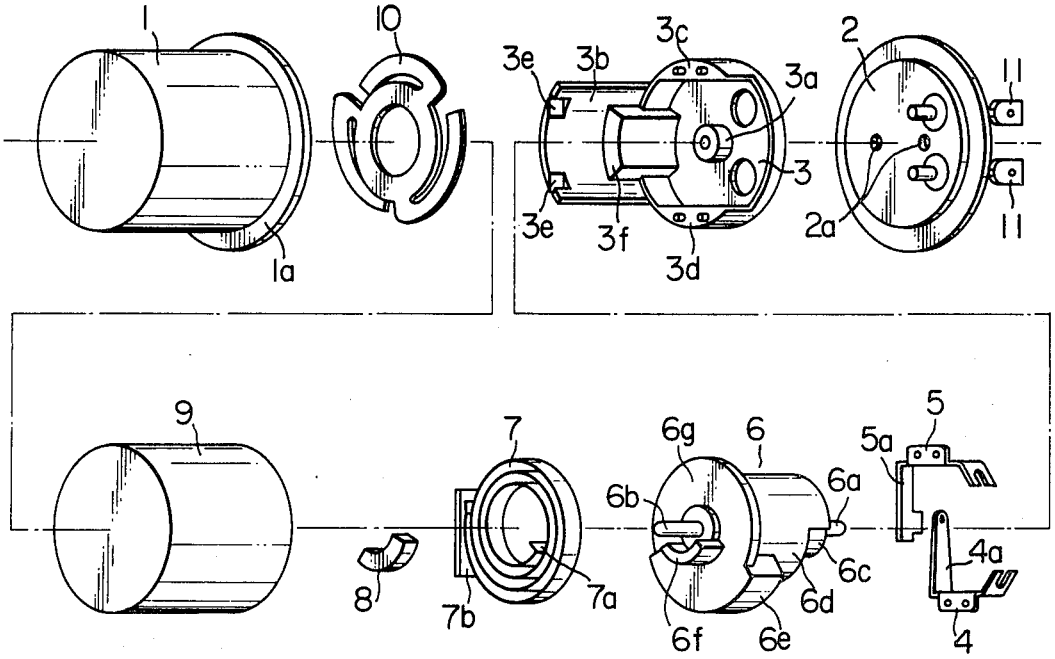
FIG. 1 is a perspective view of parts incorporated in a collision detecting device of the invention, in which the parts are arrayed in such a manner as to permit an easy understanding of the assembling order.

As will be understood from the foregoing description, the collision detecting device of the invention has a reduced number of parts which is constructed in a manner to facilitate assembly as compared with the conventional device of the kind described. Namely, the collision detecting device of the present invention can easily be assembled by fitting the parts successively in the axial direction as shown in FIG. 1. This feature permits prompt assembly of the device by an automatic assembling machine and, even if the assembly must be accomplished manually, considerably facilitates the assembly work to advantageously eliminate the necessity for skilled or trained laborers.

In addition, the simplified parts of reduced number ensures a highly reliable collision detecting performance and a reduced cost of production.

We claim:

1. A collision detecting device comprising:

a substantially cylindrical housing having an open end;

an end plate for closing the open end of said housing;

a pair of terminals fixed to said end plate;

a block disposed in said housing and having a longitudinally extending tab;

a cylindrical lid disposed in said housing opposite said block, said cylindrical lid defining a notched portion registrable with said longitudinally extending tab;

a wheel rotatably supported by said block and lid within said housing and having a cylindrical surface and a cam surface;

a pair of leaf springs fixed to said block, one end of each of said leaf springs being electrically connected to a respective one of said terminals and each of the other ends of said leaf springs being urged against and slidable on said cylindrical surface and said cam surface, respectively, said other ends of said leaf springs being normally spaced away from each other;

a spiral spring disposed in said housing and connected at one end of said wheel and at the other end to said longitudinally extending tab for biasing said wheel in a direction to move said other ends of said leaf springs away from each other; and a weight member fixed to said wheel for rotating said wheel in a direction to cause said other ends of said leaf springs to engage each other when the force produced by said weight member in the event of a collision becomes greater than the spring force of said spiral spring thereby producing an electrical signal in response to the collision.

2. A collision detecting device as claimed in claim 1, wherein said housing and said end plate are made of metallic materials and are welded over the entire periphery of their juncture to completely shield the internal space from the outside.

3. A collision detecting device as claimed in claim 2, wherein said block is made of an electrically insulating material and is provided with an electric contact fixing portion, wheel supporting bearing, projection adapted to be contacted by said wheel.

4. A collision detecting device as claimed in claim 3, wherein said wheel is made of an electrically insulating material.

* * * * *